United States Patent [19]

Kitagawa

[11] Patent Number: 4,936,179

[45] Date of Patent: Jun. 26, 1990

[54] ELECTRONIC MUSICAL INSTRUMENT

[75] Inventor: Hiroshi Kitagawa, Shizuoka, Japan

[73] Assignee: Kabushiki Kaisha Kawai Gakki Seisakusho, Shizuoka, Japan

[21] Appl. No.: 102,348

[22] Filed: Sep. 29, 1987

[30] Foreign Application Priority Data

Oct. 4, 1986 [JP] Japan ..... 61-236863

[51] Int. Cl.[5] ..... G10H 1/00; G10H 1/06; G10H 3/03

[52] U.S. Cl. ..... 84/604; 84/616; 84/654

[58] Field of Search ..... 84/1.23, 1.22, 1.28, 84/1.01, DIG. 4, 10, 1.24; 364/748

[56] References Cited

U.S. PATENT DOCUMENTS

| | | | |
|---|---|---|---|
| 3,639,913 | 2/1972 | Watson | 84/1.01 X |
| 3,743,755 | 7/1973 | Watson | 84/1.01 |
| 3,978,755 | 9/1976 | Woron | 84/DIG. 4 |
| 4,130,043 | 12/1978 | Niimi | 84/1.03 |
| 4,338,844 | 7/1982 | Murata | 84/1.23 X |
| 4,611,522 | 9/1986 | Suzuki | 84/1.01 |
| 4,620,292 | 10/1986 | Hagiwara et al. | 364/748 |

FOREIGN PATENT DOCUMENTS

| | | | |
|---|---|---|---|
| 0130332 | 1/1985 | European Pat. Off. | 84/1.01 |
| 53-143308 | 12/1978 | Japan | 84/1.22 |

OTHER PUBLICATIONS

IBM Technical Disclosure Bulletin; "Associated Floating Arithmetic For Phase Computation"; M. Cukier, L. Haas and D. Pilost; vol. 20, No. 10; (Mar. 1978).

*Primary Examiner*—A. T. Grimley
*Assistant Examiner*—Matthew S. Smith
*Attorney, Agent, or Firm*—McGlew & Tuttle

[57] ABSTRACT

To generate different frequencies, two accumulations are performed using the same calculation routine. This simplifies the system configuration and permits the fabrication of the whole system as a one-chip LSI.

1 Claim, 2 Drawing Sheets

ELECTRONIC MUSICAL INSTRUMENT

BACKGROUND OF THE INVENTION

1. Field of the Invention

The present invention relates to an electronic musical instrument of the type that accumulates phase angle data corresponding to keys being depressed and utilizes the accumulated output for accessing a waveform memory to read out therefrom musical waveform data.

2. Description of the Prior Art

Heretofore there has been used widely an electronic musical instrument of the type that accumulates phase angle data corresponding to keys being depressed and utilizes the accumulated output for accessing a waveform memory to read out therefrom waveform data of a musical frequency. The electronic musical instrument of this type employs a method of adding up the phase angle data and difference phase angle data of a little different pitch for generating a pitch-shifted frequency. This method does not matter, in principle, because it is merely a simple addition of different pieces of data. However, this method calls for an adder therefor, and hence increases the scale of the whole circuit structure, introducing difficulty in the fabrication of the circuit as a one-chip large scale integrated circuit.

FIG. 4 shows a prior art example. In FIG. 4, the output of a phase angle memory 101, which stored phase angle data $\omega 1$ for determining the fundamental frequency, and the output of a phase angle memory 102, which stores difference phase angle data $\Delta\omega 2$ for determining a pitch-shifted frequency, are added up by an adder 103, providing phase angle data $\omega 1+\Delta\omega 2$. This output is accumulated sequentially at a certain sampling clock by means of an accumulator 107 composed of an adder 104 and a register 105. The accumulator 107 outputs frequency data $F=F+(\omega 1+\Delta\omega 2)$, which is applied as an address to a wave-form memory 106, reading out therefrom waveform data of a pitch shifted from the fundamental frequency.

The prior art example employs the method that involves the calculations (1) $\omega=\omega 1+\Delta\omega 2$ and (2) $F=F+\omega$, and its circuit calls for many bus lines because the term including $\omega$ is needed in the circuit of each stage forming the whole system.

The present inventor has noticed, as a solution to this problem, that different frequencies could easily be generated simply by performing two accumulations (1) $f=f+\omega 1$ and (2) $f=f+\Delta\omega 2$ by the same accumulator while controlling the calculation cycle.

SUMMARY OF THE INVENTION

An object of the present invention is to provide an electronic musical instrument which is capable of processing different phase angle data by two accumulations and hence which has a simplified system configuration.

To attain the above object, the electronic musical instrument of the present invention, which is of the type that accumulates phase angle data corresponding to depressed keys and utilizes the accumulated output for accessing a waveform memory to read out therefrom waveform data, comprises: phase angle memory means for storing and outputting, on a time-shared basis, fundamental phase angle data $\omega 1$ for determining a fundamental frequency F1 and difference phase angle data $\Delta\omega 2$ for determining a frequency F2 ($F2=F1+\Delta F2$) of a pitch shifted from the fundamental frequency; accumulating means for accumulating the phase angle data on a time-shared basis; frequency memory means for storing the accumulated results for later read; and control means for controlling the readout of the memory means and the phase angle memory means to control the calculation cycle. By accumulating $F2=F2+\omega 1$ and $F2=F2+\Delta\omega 2$ twice on a time-shared basis, a frequency is obtained whose pitch is shifted from the fundamental frequency by $\Delta F2$.

The above procedure permits processing of two accumulations of $F2=F2+\omega 1$ and $F2=F2+\Delta\omega 2$ by the same means, and hence simplifies the system configuration, allowing ease in fabricating the whole system as a large scale integrated circuit. This differs radically from the concept of ordinary time sharing; namely, the system in which circuits are arranged discretely for simultaneous processing of all functions necessary for calculation is modified to a simple system suitable for time-sharing processing.

DESCRIPTION OF THE PREFERRED EMBODIMENTS

Figure 1:
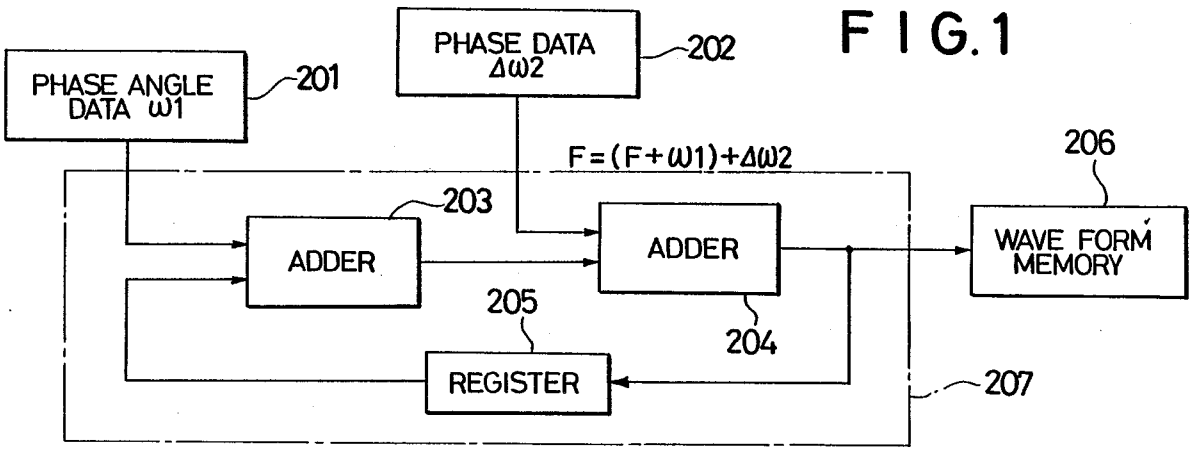
FIG. 1 is a block diagram for explaining the basic structure of the present invention.

FIG. 1 illustrates in bock form the basic structure of the present invention. At first, fundamental phase angle data $\omega 1$ read out of a phase angle memory 201 is applied to an adder 203. At the same time, the output of a register 205 for temporarily storing frequency data is applied to the adder 203, which performs a calculation $F'=F+\omega 1$. The calculated output is provided to the next adder 204. On the other hand, difference phase angle data $\Delta\omega 2$ is read out of another phase angle memory 202 and input into the adder 204, wherein a calculation $F=F'+\omega 2$ is performed. That is, the adders 203 and 204 and the register 205 constitute an accumulator 207, wherein a calculation $F=(F+\omega 1)+\Delta\omega 2$ is executed. The accumulator output is applied as an address to a waveform memory 206, reading out therefrom waveform data shifted in pitch from the fundamental frequency.

Figure 4:
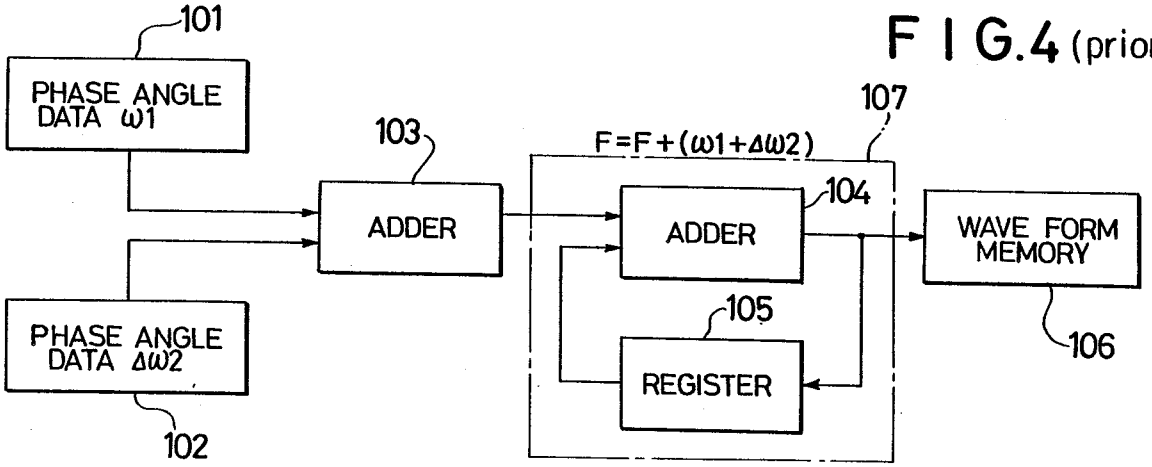
FIG.4 (prior art)
FIG. 4 is a block diagram for explaining a prior art example.

The above circuit employs circuit elements of exactly the same number as that in the case of the prior art example depicted in FIG. 4 but entirely differs therefrom in its calculation routine. The adders 103 and 104 use different calculation routines, whereas the adders 203 and 204 use the same calculation routine. Accordingly, the circuit arrangement shown in FIG. 1 is suitable for expansion into a time-sharing calculation circuit.

Figure 2:
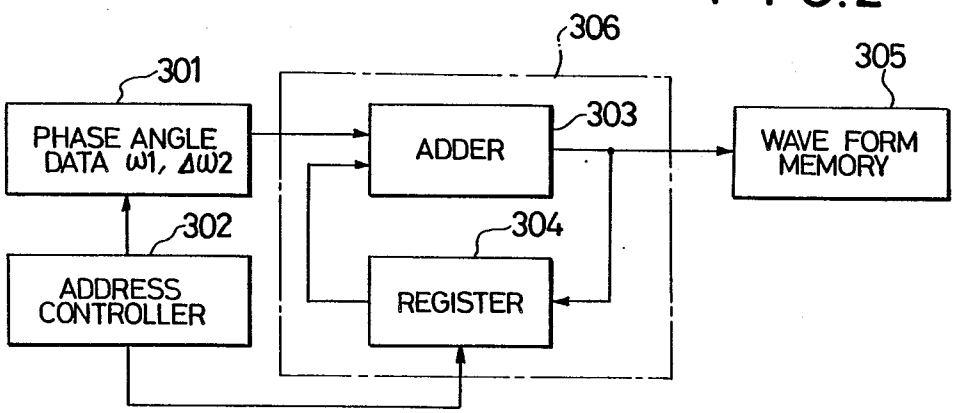
FIG. 2 is a block diagram illustrating an embodiment of the present invention.

FIG. 2 illustrates an embodiment of the present invention. A phase angle memory 301 for storing the fundamental phase angle data 1 and the difference phase angle data 2 is controlled by an address control circuit 302 so that the individual phase angle data are read out of the memory 301 on a time-shared basis. The phase angle data thus read out is applied to an accumulator 306 made up of an adder 303 and a register 304. The register 304 is controlled by the address controller 302. The output of the accumulator 306 is applied as an address to a waveform memory 305, reading out therefrom waveform data of a desired frequency.

The fundamental phase angle data $\omega 1$ is applied to the accumulator 306, wherein it is added to the previous frequency data F2, that is, a calculation $F2=F2+\omega 1$ is performed, and the calculated result is temporarily stored in the register 304. Next, the difference phase angle data $\Delta\omega 2$ is provided to the accumulator 306, wherein a calculation $F2=F2+\Delta\omega 2$ is performed. By executing the accumulation in two stages in this manner, frequency data $F2=F2+\omega 1+\Delta\omega 2$ is obtained.

The calculation of the fundamental frequency is implemented by performing a calculation $F1=F1+\omega 1$ at timing different from that in the above. That is, a frequency F2 of a pitch shifted from the fundamental frequency F1 by $\Delta F$. Incidentally, $\omega 1$ and $\Delta\omega 2$ are difference phase angle data for each sample, and by letting the sample time be represented by t, they can be expressed by $F=\omega t$. Control of these calculations is effected by the address controller 302, making it possible to perform a plurality of frequency data on the same circuit.

Figure 3:
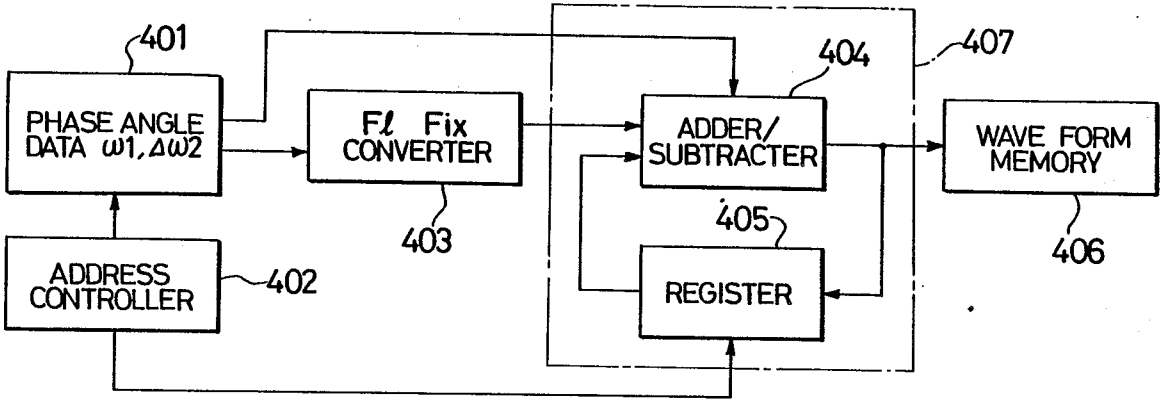
FIG. 3 is a block diagram illustrating another embodiment of the present invention.

FIG. 3 illustrates in block form another embodiment of the present invention. The storage capacity of the phase angle memory depends upon the number of tone production channels and the kinds of phase angle data which are simultaneously used in each channel. Usually, about 24 bits are needed for the phase angle data so as to cover the sound range of the electronic musical instrument and reduce a cent error (a frequency shift) relative to the pitch to be reproduced. However, where an 8-bit CPU is employed for controlling this circuit, a total of 6 bytes, i.e. 3 bytes for the fundamental frequency and 3 bytes for the difference frequency, are needed for each tone, and the data transfer time poses a problem.

In this embodiment, floating point type data is used as the phase angle data and is expressed using a total of 16 bits, for example, 11 bits for the mantissa part, 3 bits for the exponent part, and 1 bit as a sign bit. In consequence, the quantity of data is 4 bytes, reducing the data transfer time. Moreover, by generating a negative frequency, positive and negative difference pitches can be implemented as expressed by $F=F1\pm\Delta F2$.

Phase angle data stored as the floating point type data in a phase angle memory 401 is read out by an address control circuit 402 and is provided to an F1-Fix converter 403 for conversion to fixed point type data. The converter output is applied to an accumulator 407 formed by an adder/subtractor 404 and a register 405, and the accumulated output is applied as an address to a waveform memory 406, reading out therefrom waveform data of a desired frequency. The sign bit of the phase angle data is provided to the adder/subtractor 404 to control its addition/subtraction. The calculation cycle is the same as in the embodiment shown in FIG. 2. By such time-shared calculations only one F1-Fix converter suffices. Furthermore, by controlling the aforementioned calculations so that the calculation of the fundamental phase angle, $F2+F2+\omega 1$, is not performed, the pitch-shifted frequency can be performed as an independent frequency, not dependent upon the fundamental frequency.

As described above, according to the present invention, different frequencies are generated by performing two accumulations through use of the same calculation routine. This simplifies the system configuration, and hence permits the fabrication of the whole system as a one-chip LSI.

It will be apparent that many modifications and variations may be effected without departing from the scope of the novel concepts of the present invention.

What is claimed is:

1. An electronic musical instrument which accumulates phase angle data corresponding to depressed keys and utilizes the accumulated output for accessing a waveform memory to read out therefrom waveform data comprising:

phase angle memory means for a storing and outputting on a time-shared basis, fundamental phase angle data $\omega 1$ for determining a fundamental frequency F1 and difference phase angle data $\Delta\omega 2$ for determining a frequency F2, ($F2=F1+\Delta F2$) of a pitch shifted from the fundamental frequency the data stored in the phase angle memory means being floating point type data expressed by $M\times 2^{-P}$, where P is an exponent part and M a mantissa part, and containing a negative value;

fixed point converting means whereby the floating point type phase angle data output from the phase angle memory means is converted to fixed point type phase angle data;

accumulating means for accumulating the phase angle data on a time-shared basis the phase angle data being output from the fixed point converting means;

frequency memory means for storing the accumulated results for later read; and calculation control means for controlling the readout of the frequency memory means and controlling the readout of the phase angle memory means for accumulating two calculation cycles $F2=F2+\omega 1$ and $F2=F2+\Delta\omega 2$ on a time-shared basis, thereby obtaining a frequency shifted in pitch from the fundamental frequency by $\Delta F2$ which is determined by phase angle data $\Delta\omega 2$.

* * * * *